United States Patent [19]

Haglund

[11] Patent Number: 4,538,997

[45] Date of Patent: Sep. 3, 1985

[54] REVERSING MEANS IN WATER-JET PROPULSION UNITS

[76] Inventor: Kjell Haglund, Karlstad, Sweden

[21] Appl. No.: 459,252

[22] Filed: Jan. 19, 1983

[30] Foreign Application Priority Data

Jan. 27, 1982 [SE] Sweden ..... 8200417

[51] Int. Cl.[3] ..... B63H 11/10

[52] U.S. Cl. ..... 440/41; 440/43; 244/110 B; 239/265.29

[58] Field of Search ..... 440/40, 41, 43; 244/110 B, 23 D, 12.5; 239/265.27, 265.29

[56] References Cited

U.S. PATENT DOCUMENTS

| | | | |
|---|---|---|---|
| 2,944,394 | 7/1960 | Peregrine | 244/110 B |
| 3,475,912 | 11/1969 | Angier | 440/41 |
| 3,483,702 | 12/1969 | Ward | 239/265.29 |
| 3,599,874 | 8/1971 | Hom et al. | 239/265.29 |
| 3,716,207 | 2/1973 | Schweikl et al. | 239/265.29 |
| 3,764,096 | 10/1973 | Wright | 244/110 B |
| 3,997,134 | 12/1976 | Drakeley | 244/110 B |

FOREIGN PATENT DOCUMENTS

| | | | |
|---|---|---|---|
| 1227782 | 10/1966 | Fed. Rep. of Germany | 239/265.29 |
| 653223 | 2/1963 | Italy | 440/43 |

*Primary Examiner*—Trygve M. Blix
*Assistant Examiner*—Thomas J. Brahan
*Attorney, Agent, or Firm*—Browdy and Neimark

[57] ABSTRACT

The invention relates to a reversing means in a marine-water-jet propulsion unit, which includes a pump (4) having connected thereto a nozzle tube (14) for directing the driving jet of water. The lower wall (14*a*) of the tube is provided with an opening (16), and the reversing means includes an inner flap (17) and an outer flap (18) arranged to close the opening from the inside and the outside respectively of the tube. The inner flap (17) can be swung about its fore end, as seen in the direction of flow of water through the tube, between the closed position and a position in which it is swung inwardly in the tube (14), in which position the flap (17) completely or partially blocks the flow path through the tube and deflects the water flow completely or partially out through the opening (16) in the wall of the tube. The outer flap (18) can also be swung about its fore end, as seen in the direction of flow of water through the tube, between the closed position and a position in which the flap is swung outwardly from the tube and in which the flap is directed obliquely downwardly and rearwardly, as seen in the direction of flow of water through the tube. When the outer flap occupies this open position, it directs the stream of water exiting through the opening (16) in the tube wall obliquely downwardly and rearwardly relative to the direction of flow of water through the tube. The two flaps (17, 18) have a common operating means (19, 24) for simultaneous pivoting of the flaps between their closed position and their open position (FIG. 1).

6 Claims, 2 Drawing Figures

REVERSING MEANS IN WATER-JET PROPULSION UNITS

Figure 1:
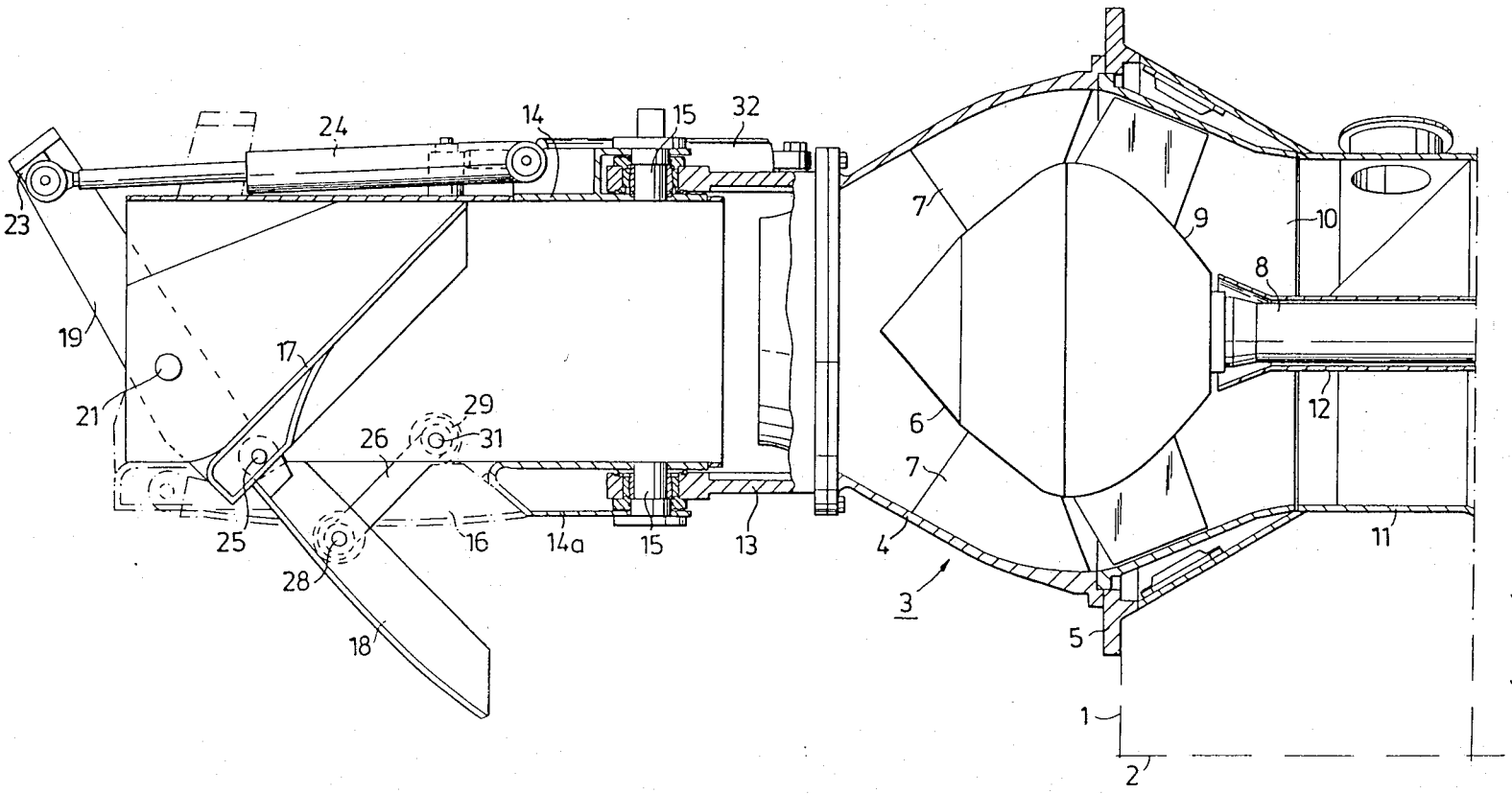

The present invention relates to a reversing means in a water-jet propulsion unit for waterborne craft.

In principle, a water-jet propulsion unit for waterborne craft includes a pump, normally a propeller or impeller pump, which is mounted in some suitable fashion, normally in the stern or aft part of the craft, and the inlet of which pump is connected to a water inlet passage extending from an intake opening in the bottom of the craft, and the outlet of which pump is connected to means incorporating a tube or nozzle which projects outwardly beyond the stern of the craft and which is intended to form and direct the driving water jet.

For steering purposes, the tube is normally arranged to be swung laterally about a vertical axis. For reversing the thrust direction of the unit for retarding the speed of the craft or for propelling the craft astern, the arrangement is normally such as to fully deflect the stream of water passing through the tube, or to deflect a variable part of said stream, so that instead of being directed rearwardly relative to the craft, the water stream is directed forwardly, normally obliquely downwardly and forwardly. For the purpose of reversing the direction of the water jet, it is previously known to arrange an opening in the lower part of the tube wall and to provide a bucket-like means arranged to be swung through the opening in the tube wall, from a position in which the bucket-like means is located completely outside the tube and closes said opening, to a position in which the bucket is located within the tube to variable extents, such that part of the water stream flowing through the tube is deflected out through said opening, via said bucket, in the form of a downwardly and forwardly directed water jet. When the bucket-like means is moved fully into the tube to the limit of its movement, the bucket fully closes the straight flow-passage through the tube, and the whole of the water stream is deflected by the bucket through the opening in the tube wall, in the form of an obliquely, down-wardly and forwardly directed jet. One such known reversing means for marine water-jet units is found described, for example, in Swedish patent application No. 8008288-6.

One serious disadvantage with this and other known reversing means, however, is that in normal sailing conditions of the vessel or craft, the bucket-like reversing means projects beneath the tube quite considerably. Even though the tube is normally located somewhat above the surface of the water, it is difficult to completely prevent the bucket-like reversing member, which extends beneath the tube, from entering the water at least temporarily, for example when washed by waves or by the swell created by the craft to which the unit is mounted, and this in particular when the craft changes course while moving forward. As will readily be understood, this will result in loss of speed and will disturb the performance of the vessel underway. In addition, the bucket-like reversing member is subjected to very high and serious stresses and strains, as will also the tube carrying said member and the water jet unit in its entirety.

Consequently an object of the present invention is to provide in marine water-jet propulsion units an improved reversing means which is not encumbered with the aforementioned disadvantages encountered with known reversing means.

This object is achieved with a reversing means having the characteristic features set forth in the accompanying claims.

Figure 2:
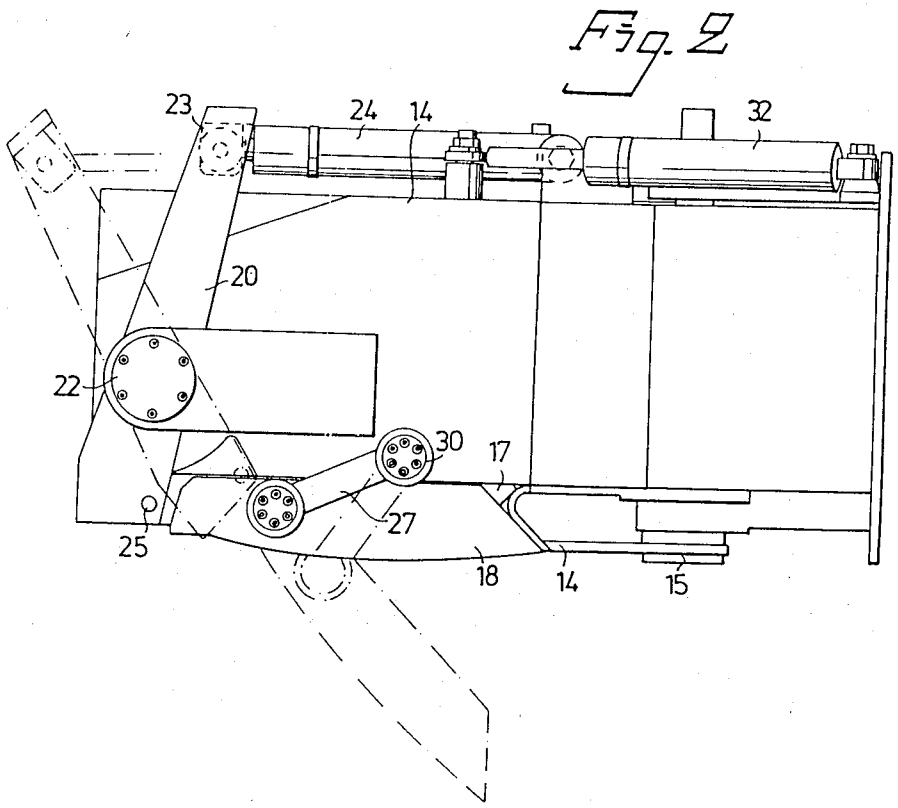

The invention will now be described in more detail with reference to an exemplary embodiment of a reversing means according to the invention illustrated in the accompanying drawings, in which FIG. 1 is an axial, vertical sectional view of the rear part of a marine water-jet propulsion unit provided with a reversing means according to the invention, the reversing means being illustrated in a fully reversing position; and FIG. 2 is a side view of solely the jet-directing tube and the reversing means illustrated in FIG. 1, the reversing means being illustrated in an inactive position.

The water-jet unit illustrated by way of example in the drawing is mounted in the stern of a waterborne craft, the stern structure 1 and the keel 2 of which are illustrated schematically in chain lines in FIG. 1. The water-jet unit comprises a propeller pump, generally identified at 3, having a pump housing 4 which is mounted on a mounting flange 5 arranged to encircle an opening in the transom 1 of the vessel. Arranged in the pump housing 4 centrally of the flow path of the water through said housing is a hub housing 6 which is supported by guide vanes 7 which extend between the inner surface of the wall of said pump housing 4 and the outer surface of the hub housing 6. A pump impeller 9 mounted on one end of a drive shaft 8 is journalled in the hub housing 6. The pump housing 4 has an inlet opening 10 which communicates with an inlet passage 11 which extends from a water-intake (not shown) in the bottom 2 of the vessel to the transom 1, where the inlet passage is connected to the mounting flange 5. The drive shaft 8 projects into the pump housing 4 through the inlet passage 11, and is embraced by a sleeve 12 so as to reduce the effect of the rotating pump shaft 8 on the flow of water through the inlet passage 11. The pump housing 4 is connected on its outlet side to an outlet tube 13, in which nozzle tube 14 for directing the driving water jet is mounted. For the purpose of steering the craft, the tube 14 can be swung laterally about pivots 15, by means of hydraulic piston-cylinder devices 32.

The structural design and operational mode of the illustrated water-jet unit is described in more detail in the previously mentioned Swedish patent application 8008288-6.

For the purpose of reversing the thrust direction of the unit, in order to retard or to reverse the vessel, the tube 14 is provided with a reversing means according to the invention. To this end, the lower wall **14*a* of the tube 14, which in cross section is substantially of a four-sided configuration, is provided with an opening 16 which, in the illustrated embodiment, extends right to the outer end of the tube and across the whole width of the lower wall 14*a* of said tube. The actual reversing means includes an inner, substantially rectangular flap 17 and an outer, substantially rectangular flap 18. The flaps 17, 18 have a width which corresponds substantially to the width of the opening 16. The length of the inner flap 17 corresponds substantially to the length of the opening 16, while the outer flap 18 is somewhat shorter. The fore end of the inner flap 17, as seen in the direction in which the water flows through the tube 14, is rigidly connected to two operating levers 19, 20 which are arranged on the outside of the two mutually opposite side walls of the tube 14 and which are connected to said fore end of the inner flap 17 on a respective side thereof. The two operating levers 19, 20 are substantially at right angles to the flap 17 and are mounted pivotally about a horizontal axis 21, in bearing means 22 (see FIG. 2) arranged on the outside of the side walls of the tube 14, said axis 21 extending at right angles to the longitudinal axis of the tube 14. The upper ends of the two operating levers 19, 20 are rigidly connected together by means of a horizontal cross-piece 23, to which there is connected the piston rod of a hydraulic piston-cylinder device 24 mounted on the tube 14**.

As will readily be seen, the flap 17 can be swung by means of the hydraulic piston-cylinder device 24 and the operating levers 19, 20 between the maximum open position shown in full lines in FIG. 1 and the fully closed or inactive position shown in chain lines in FIG. 1. In FIG. 2, the closed, inactive position of the reversing means is illustrated by means of full lines, while the maximum open, active position is illustrated by means of chain lines. In its fully closed position, the flap 17 is in line with the lower wall **14*a* of the tube 14 and fully closes the opening 16, so that the whole of the stream of water passing through tube 14 flows out in a straight rearward direction, to drive the vessel forwards. In its maximum open position, illustrated in FIG. 1, the flap 17 fully closes the flow path through tube 14 and deflects the whole of the stream of water through opening 16 located in the lower wall 14*a* of the tube. The flap 17 can also be moved by means of the piston-cylinder device 24 and the operating levers 19, 20 into intermediate positions, in which the flap 17 will deflect through the opening 16 only part of the flow of water through tube 14**.

The fore end of the outer flap 18, as seen in the direction of flow through the tube 14, is pivotally connected to the inner flap 17 about a pivot axis 25. The reversing means also includes two, mutually parallel link arms 26 and 27 each of which is arranged on the outside of a respective one of the two mutually opposite side walls of the tube 14. The two link arms 26, 27 are pivotally connected at one end thereof to the outer flap 18 on a respective side thereof, the common pivot axis for said one ends of said link arms 26, 27 being referenced 28 in FIG. 1. The opposite ends of the link arms 26, 27 are pivotally mounted in bearings 29 and 30, arranged on the outside of the two mutually opposite side walls of the tube 14, and have a common pivot axis referenced 31 in FIG. 1.

It will be seen that when the inner flap 17 is swung in the previously described manner between a fully closed position and a fully open position, by means of the hydraulic piston-cylinder device 24 and the operating levers 19, 20, the outer flap 18 will also automatically be swung substantially symmetrically relative to the inner flap 17, between the fully closed position, shown in chain lines in FIG. 1, and the fully open position, shown in full lines in FIG. 1. When the flap 18 occupies its closed position, the flap is in line with the lower wall **14*a* of the tube 14 in the opening 16, and is thus coactive in closing said opening, while when occupying its open position said flap is directed obliquely downwardly and rearwardly, as seen relative to the flow of water through the tube 14, whereby said flap directs the flow of water deflected by the inner flap 17 out through the opening 16** in the form of an obliquely rearwardly and forwardly directed water jet, as seen in the direction of movement of the vessel, said jet providing the reversed thrust direction from the water-jet unit desired for retarding the speed of the vessel or for moving said vessel astern.

The two flaps 17, 18 have substantially U-shaped cross-sections which are open towards the opening 16 in the wall **14*a* of the tube, and the outer flap 18 is somewhat wider than the inner flap 17, so that in the closed position of the flaps the outer flap 18 accomodates the inner flap 17. It will be seen that in the inactive position of the reversing means, when the two flaps 17 and 18 are fully closed, the two flaps lie in line with the bottom wall 14*a* of the tube substantially completely within the opening 16**, and hence the reversing means can have no disturbing influence whatsoever on the performance of the vessel.

As will be understood, the manouevering mechanism common to the two flaps of a reversing means according to the invention may have a form different to that described above and illustrated in the drawing. It will also be understood that a reversing means according to the invention can also be used in a marine water-jet propulsion unit having a design different to that described above and illustrated in the drawing, for example with respect to the design and positioning of the pump and with respect to the form of the water-inlet passage, etc.

I claim:

1. A reversing means in a marine water-jet propulsion unit including a pump having an outlet side connected to a nozzle tube for forming and directing a driving water jet, said reversing means comprising:

an opening in a wall of said tube;

an inner flap and an outer flap normally arranged for closing said opening from the inside and outside, respectively, of said tube, said inner flap being pivotable between said closed position in said opening and an open position in which said inner flap is swung inwardly into said tube to expose said opening and to substantially block the path of flow of water through said tube, and said outer flap being pivotable between said closed position in said opening and an open position in which said outer flap projects outwardly, and in an upstream direction relative to the direction of flow of the water through said tube, to expose said opening;

and a common operating means connected to said inner and outer flaps for pivoting them simultaneously between their said closed, and open, positions, each of said flaps being pivotable about its downstream end, said inner flap downstream end being rigidly connected to an operating lever which forms an angle with the inner flap and which is pivotable about an axis which is stationary relative to the tube and which extends at right angles to the longitudinal direction of the tube, in a manner such that the inner flap can be swung, by swinging the operating lever about said axis, between its said closed and open positions;

said downstream end of the outer flap being pivotally connected to the downstream end of the inner flap about a pivot axis extending parallel to the pivot axis of the operating lever;

and a link arm pivotally connected at its one end to the outer flap at a location spaced from the downstream end of the outer flap about an axis which is parallel with said previously mentioned axes, and pivotally connected at its opposite end about an axis which is fixed relative to the tube and which is also parallel with said previously mentioned axes.

2. A reversing means as claimed in claim 1, wherein said inner flap, when in its said open position, is obliquely positioned relative to the longitudinal axis of the tube, in a manner such that it assists to deflect the flow of water in said tube out through said opening.

3. A reversing means as claimed in claim 1, comprising two, mutually parallel operating levers of the aforesaid kind, which are arranged externally of the tube on mutually opposite sides thereof and are connected to the downstream end of the inner flap on a respective side of said flap, and also two mutually parallel link arms of the aforesaid kind arranged externally of the tube on mutually opposite sides thereof, said link arms being connected to the outer flap on a respective side thereof.

4. A reversing means as claimed in claim 3, wherein the ends of said two operating levers remote from said inner flap are rigidly interconnected by means of a cross-piece to which there is connected a power-generating operating means for pivoting the operating levers.

5. A reversing means as claimed in claim 1, wherein said tube is substantially of four-sided cross-section, and said opening is located in the lower wall of the tube.

6. A reversing means as claimed in claim 1, wherein said inner and outer flaps are substantially of U-shaped cross-sections open towards said opening in the wall of the tube, one of said flaps being somewhat wider than the other flap so that said other flap can be accomodated in said one flap when the flaps are in said closed positions.

* * * * *